US011204160B2

(12) United States Patent
Murayama et al.

(10) Patent No.: US 11,204,160 B2
(45) Date of Patent: Dec. 21, 2021

(54) LIGHT SOURCE DEVICE

(71) Applicant: HAMAMATSU PHOTONICS K.K., Hamamatsu (JP)

(72) Inventors: Kyoichi Murayama, Hamamatsu (JP); Keita Umeno, Hamamatsu (JP); Hiroya Kashiwabara, Hamamatsu (JP); Ryotaro Matui, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 17/116,213

(22) Filed: Dec. 9, 2020

(65) Prior Publication Data

US 2021/0088207 A1 Mar. 25, 2021

Related U.S. Application Data

(62) Division of application No. 16/136,554, filed on Sep. 20, 2018, now Pat. No. 10,895,376.

(30) Foreign Application Priority Data

Sep. 22, 2017 (JP) ..... JP2017-182473

(51) Int. Cl.
*F21V 29/74* (2015.01)
*F21V 29/76* (2015.01)
(Continued)

(52) U.S. Cl.
CPC ..... *F21V 29/74* (2015.01); *F21S 4/28* (2016.01); *F21V 15/01* (2013.01); *F21V 29/677* (2015.01);
(Continued)

(58) Field of Classification Search
CPC .... F21S 4/20; F21S 4/28; F21V 15/01; F21V 29/74–78; F21V 29/83; B41J 2/435–473
See application file for complete search history.

(56) References Cited

U.S. PATENT DOCUMENTS 7,338,186 B1 ‡ 3/2008 Wu ..... F21S 2/005 362/240
7,547,123 B2 * 6/2009 Kittredge ..... F21K 9/00 362/218
(Continued)

FOREIGN PATENT DOCUMENTS

JP 3104468 U 9/2004
JP 2006-259290 A 9/2006
(Continued)

OTHER PUBLICATIONS

TW-201040453-A1 English machine translation (Year: 2010).‡

*Primary Examiner* — Mariceli Santiago
(74) *Attorney, Agent, or Firm* — Faegre Drinker Biddle & Reath LLP

(57) ABSTRACT

A light source device includes a housing having a great length along a predetermined direction, a plurality of light emitting elements which are placed in the housing and are arranged along the predetermined direction, and one or more heat dissipation members which are placed in the housing and are thermally connected with the light emitting elements. A first intake port through which air is sucked into the housing is provided in one end in the housing. An exhaust port through which air is discharged to an outside is provided in the other end in the housing. A space where the other side in the predetermined direction faces the heat dissipation member is formed in the housing. A second intake port through which air is sucked into the space from the outside is provided in a side surface between the first intake port and the exhaust port in the housing.

8 Claims, 10 Drawing Sheets

(51) Int. Cl.

| | |
|---|---|
| ***F21V 29/83*** | (2015.01) |
| ***F21V 29/67*** | (2015.01) |
| ***F21S 4/28*** | (2016.01) |
| ***F21V 15/01*** | (2006.01) |
| *F21Y 115/10* | (2016.01) |
| *F21Y 103/10* | (2016.01) |
| *B41J 2/45* | (2006.01) |

(52) U.S. Cl.
CPC ..... *F21V 29/76* (2015.01); *F21V 29/83* (2015.01); *B41J 2/45* (2013.01); *F21Y 2103/10* (2016.08); *F21Y 2115/10* (2016.08)

(56) References Cited

U.S. PATENT DOCUMENTS 8,864,332 B2 ‡ 10/2014 Ter-Hovhannisyan ..... F21V 3/0625 362/218
2010/0142212 A1 * 6/2010 Tahmosybayat ..... F21V 29/677 362/373
2011/0063832 A1 ‡ 3/2011 Hu ..... F21V 29/74 362/235
2011/0317420 A1 12/2011 Jeon et al.
2015/0198321 A1 ‡ 7/2015 Druchinin ..... H05B 33/0803 362/235
2016/0178178 A1 ‡ 6/2016 Brumm ..... F21V 29/67 362/373
2016/0305640 A1 ‡ 10/2016 Brown ..... F21V 29/673
2019/0137089 A1 ‡ 5/2019 Grady ..... F21V 29/83

FOREIGN PATENT DOCUMENTS

JP 2011-165509 A ‡ 8/2011
JP 2012-024993 A 2/2012
JP 2012-74422 A 4/2012
KR 101228757 B1 * 1/2013 ..... F28D 15/0275
TW 201040453 A 11/2010
TW 201040453 A1 ‡ 11/2010
WO WO-2012014516 A1 * 2/2012 ..... B41J 2/45
WO WO-2015/129419 A1 9/2015
WO WO-2015129419 A1 ‡ 9/2015 ..... F21V 29/506

* cited by examiner
‡ imported from a related application

LIGHT SOURCE DEVICE

CROSS-REFERENCE TO RELATED APPLICATIONS

This application is a divisional of U.S. patent application Ser. No. 16/136,554, filed Sep. 20, 2018, which claims the benefit of Japanese Patent Application No. 2017-182473, filed Sep. 22, 2017, the entire contents of each of which has been incorporated herein by reference.

TECHNICAL FIELD

One aspect of the present invention relates to a light source device.

BACKGROUND

Known is a light source device including a plurality of light emitting elements which are arranged along a predetermined direction in a housing having a great length along the predetermined direction. In the above-described light source device, an intake port and an exhaust port are respectively provided in one end and the other end of the predetermined direction in the housing, to cool the plurality of light emitting elements, in one instance. However, in such an instance, a light emitting element in one end is cooled to a greater extent than a light emitting element in the other end, and thus, light outputs of the plurality of light emitting elements cannot be equalized. Meanwhile, in the above-described light source device, an intake port is provided in a side surface between the one end and the other end in the housing and an exhaust port is provided in the other end of the housing, to cool the plurality of light emitting elements, in another instance. However, in such an instance, a light emitting element in the other end is cooled to a greater extent than a light emitting element in one end, and thus light outputs of the plurality of light emitting elements cannot be equalized.

As a technique for uniformly cooling the plurality of light emitting elements in the above-described light source device, devices described in Japanese Unexamined Patent Publication No. 2011-165509 and Japanese Unexamined Patent Publication No. 2012-074422 are known, for example. In an LED lighting device described in Japanese Unexamined Patent Publication No. 2011-165509, an LED-equipped substrate which is equipped with a plurality of LEDs is mounted onto a heat dissipation block, and heat of the LEDs is dissipated by the heat dissipation block. In the LED lighting device described in Japanese Unexamined Patent Publication No. 2011-165509, a first channel through which a refrigerant flows from one end to the other end of the heat dissipation block, and a second channel through which a refrigerant flows from the other end to one end of the heat dissipation block, are provided. Thus, the plurality of light emitting elements are cooled.

In an LED unit described in Japanese Unexamined Patent Publication No. 2012-074422, a plurality of LEDs are mounted onto a heat dissipation member including a channel through which a refrigerant flows along a lengthwise direction. In the LED unit described in Japanese Unexamined Patent Publication No. 2012-074422, a refrigerant is introduced into a channel from a lengthwise center, and the foregoing channel includes a channel through which a refrigerant flows from a lengthwise center to one end, and a channel through which a refrigerant flows from a lengthwise center to the other end. Thus, a plurality of light emitting elements are cooled.

SUMMARY

In a light source device, it is required to equalize temperatures of a plurality of light emitting elements so that respective light outputs of the plurality of light emitting elements are kept constant. In this regard, because of inclusion of a plurality of exhaust portions, a need of providing a plurality of channels for a refrigerant, or the like, the above-described conventional techniques still have room for improvement from a viewpoint of reducing the number of components or simplifying a configuration. In particular, in a light source device mounted onto a UV printing apparatus, for example, positions and the numbers of intake ports and exhaust ports of the light source devices are limited in order to reduce an influence of air upon an illuminated object (a printed material on which UV-light-curing ink deposits), in some cases.

It is an object of one aspect of the present invention to provide a light source device which can equalize temperatures of a plurality of light emitting elements.

A light source device according to one aspect of the present invention includes: a housing configured to have a great length along a predetermined direction; a plurality of light emitting elements configured to be placed in the housing and arranged along at least the predetermined direction; and one or a plurality of heat dissipation members configured to be placed in the housing and thermally connected with the light emitting elements, wherein a first intake port through which air is sucked into the housing from an outside is provided in one end on one side of the housing in the predetermined direction, an exhaust port through which air is discharged to the outside from the housing is provided in another end on an other side of the housing in the predetermined direction, a space in which the other side in the predetermined direction faces the heat dissipation member is formed in the housing, and a second intake port through which air is sucked into the space from the outside is provided in a side surface between the first intake port and the exhaust port in the housing.

In this light source device, while air sucked through the first intake port on the one side is flowing toward the exhaust port on the other side in the housing, outside fresh air is sucked into the space in the housing via the second intake port in the side surface. Since the other side of the space faces the heat dissipation member, the fresh air which is sucked into the space easily flows into the heat dissipation member on the other side. Accordingly, temperature rise of the light emitting element which is placed on a side close to the exhaust port and thus is easily subjected to temperature rise is effectively suppressed and a temperature gradient among the plurality of light emitting elements is reduced, so that temperatures of the plurality of light emitting elements can be equalized.

In the light source device according to one aspect of the present invention, the heat dissipation member may be a heat sink including a plurality of heat dissipation fins, and the space may be defined by notches formed in the heat dissipation fins. With such the space as described above, it is possible to effectively achieve a technique in which outside fresh air is sucked via the second intake port and is allowed to flow into the heat dissipation fins on the other side.

In the light source device according to one aspect of the present invention, the plurality of heat dissipation members may be placed so as to be arranged along the predetermined direction, and the space may be formed between a pair of adjacent heat dissipation members out of the plurality of heat dissipation members. In this situation, in a case where a plurality of heat dissipation members are placed, the space can be efficiently formed.

In the light source device according to one aspect of the present invention, each of the heat dissipation members may be a heat sink including a plurality of heat dissipation fins, and the space may be defined by notches formed in the heat dissipation fins respectively provided in the pair of the adjacent heat dissipation members. With such the space as described above, in a case where a plurality of heat dissipation members are placed, it is possible to effectively achieve a technique in which outside fresh air is sucked via the second intake port and is allowed to flow into the heat dissipation fins on the other side.

In the light source device according to one aspect of the present invention, the second intake port may be provided in an end on a side spaced apart from an illuminated object irradiated with light from the light emitting elements, in the side surface. In this situation, even if mist, gas or a powdered material (which will be also referred to as "mist or the like") is possibly produced from an illuminated object, for example, the mist or the like can be prevented from being sucked into the housing via the second intake port.

In the light source device according to one aspect of the present invention, the housing may include an outer sidewall between the first intake port and the exhaust port, and an inner sidewall located inwardly with respect to the outer sidewall, an inter-wall space in which air sucked through the first intake port is allowed to flow along the predetermined direction may be formed between the outer sidewall and the inner sidewall in the housing, and the second intake port may be provided so as not to communicate with the inter-wall space while communicating with the space. In this situation, air which is sucked through the first intake port is allowed to flow in the inter-wall space, and so it is possible to surely allow outside fresh air which is sucked through the second intake port to flow into not the inter-wall space, but the space, and then, the heat dissipation member, while suppressing temperature rise of the housing.

DETAILED DESCRIPTION

Figure 1:
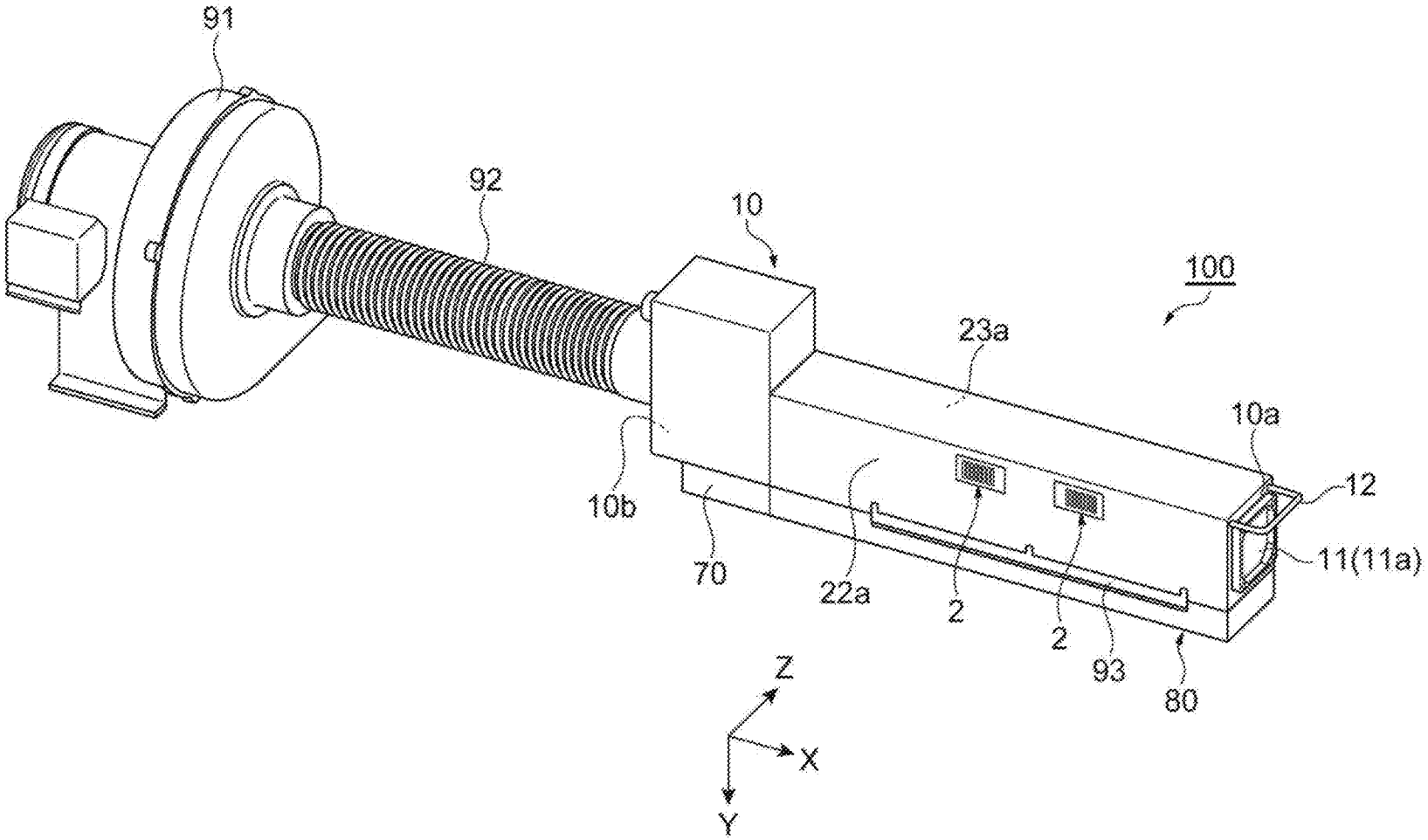
FIG. 1 is a perspective view showing a light source device according to one embodiment.

Hereinafter, an embodiment will be described in detail with reference to the drawings. In the following description, the same or corresponding elements will be denoted by the same reference numerals, and duplicated description will be avoided.

Figure 2:
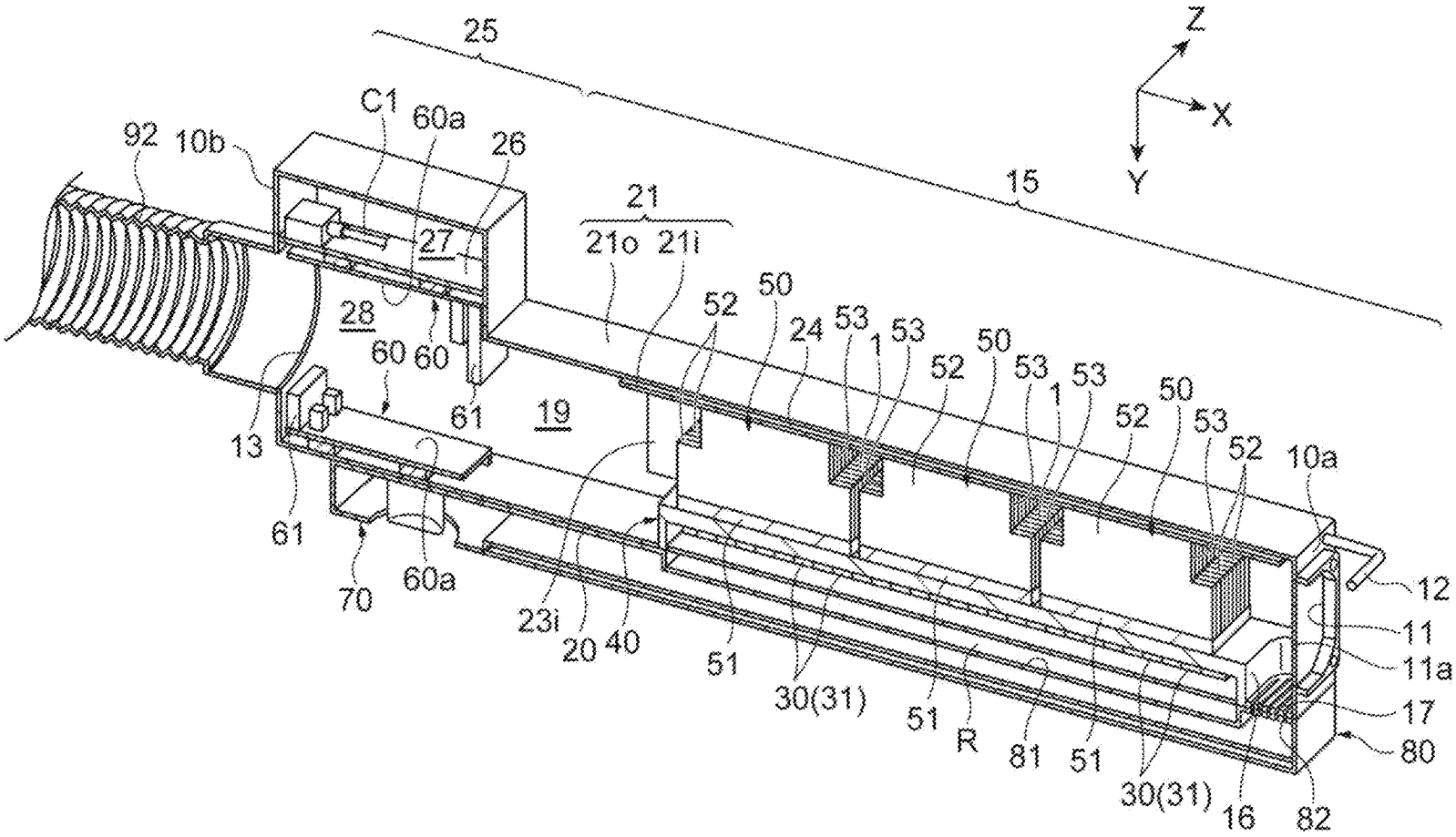
FIG. 2 is a perspective view of a section of the light source device in FIG. 1.
Figure 3:
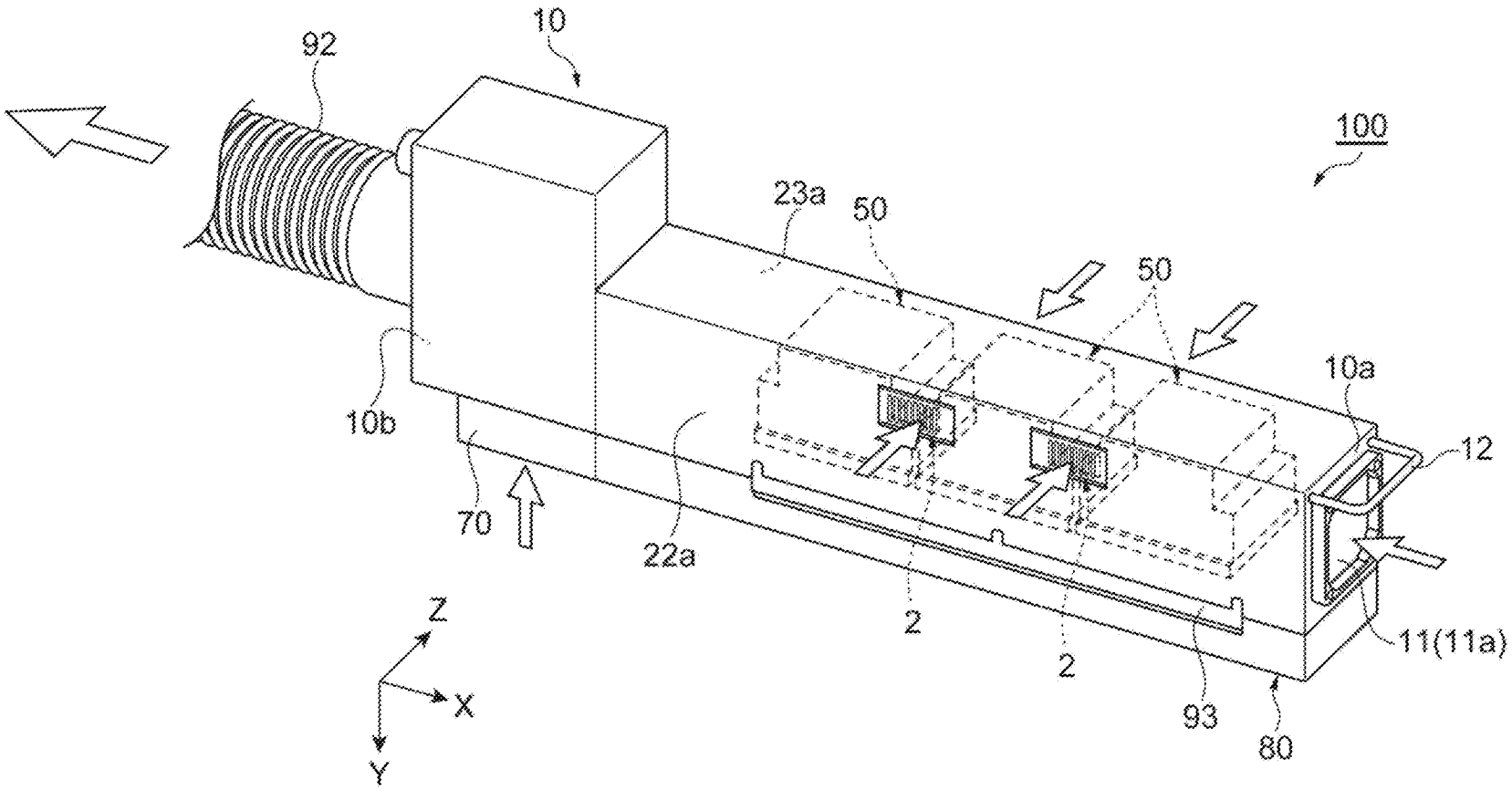
FIG. 3 is a perspective view showing an air flow in the light source device in FIG. 1.
Figure 4:
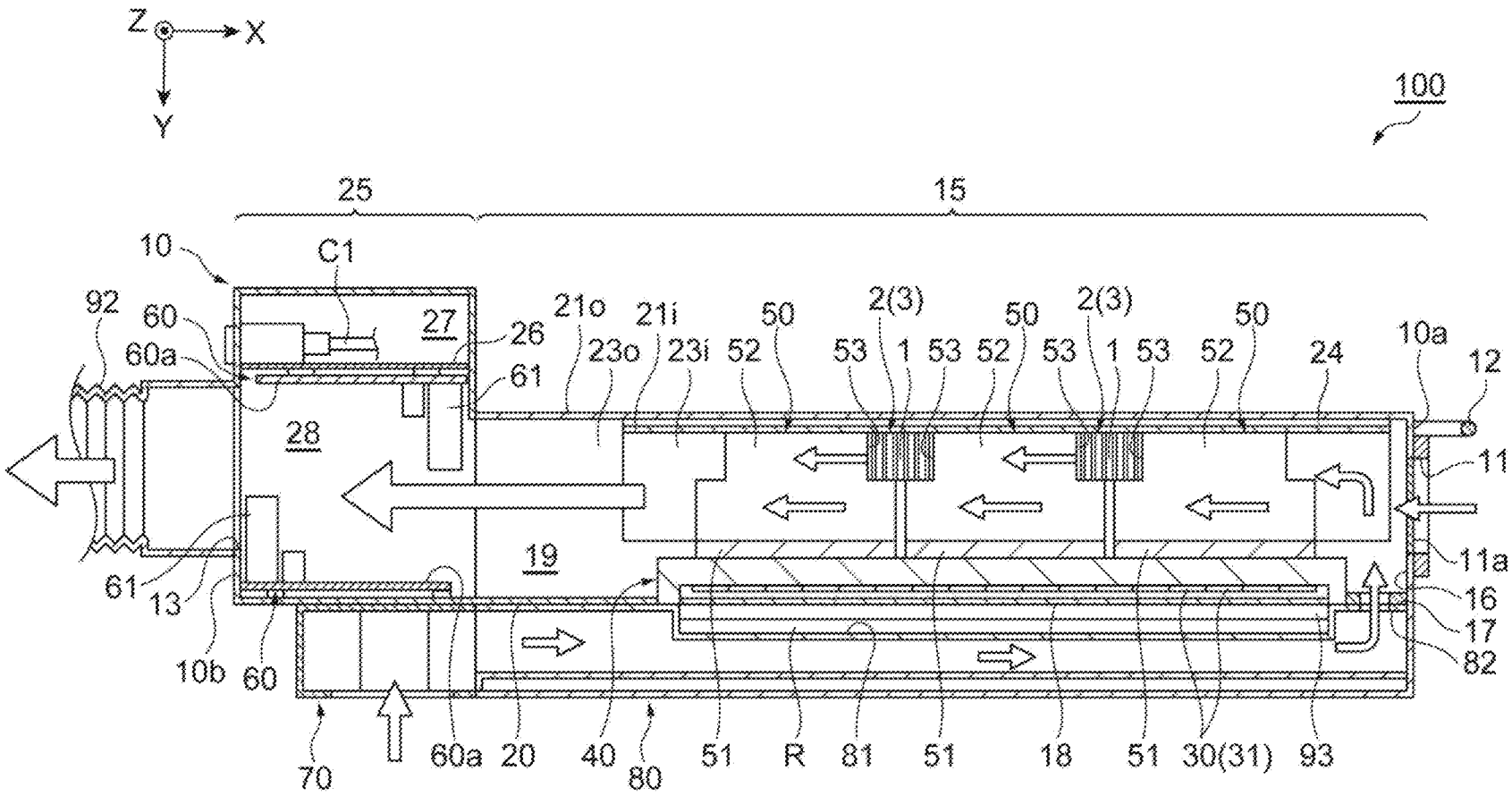
FIG. 4 is a longitudinal section view for showing an air flow in the light source device in FIG. 1.
Figure 5:
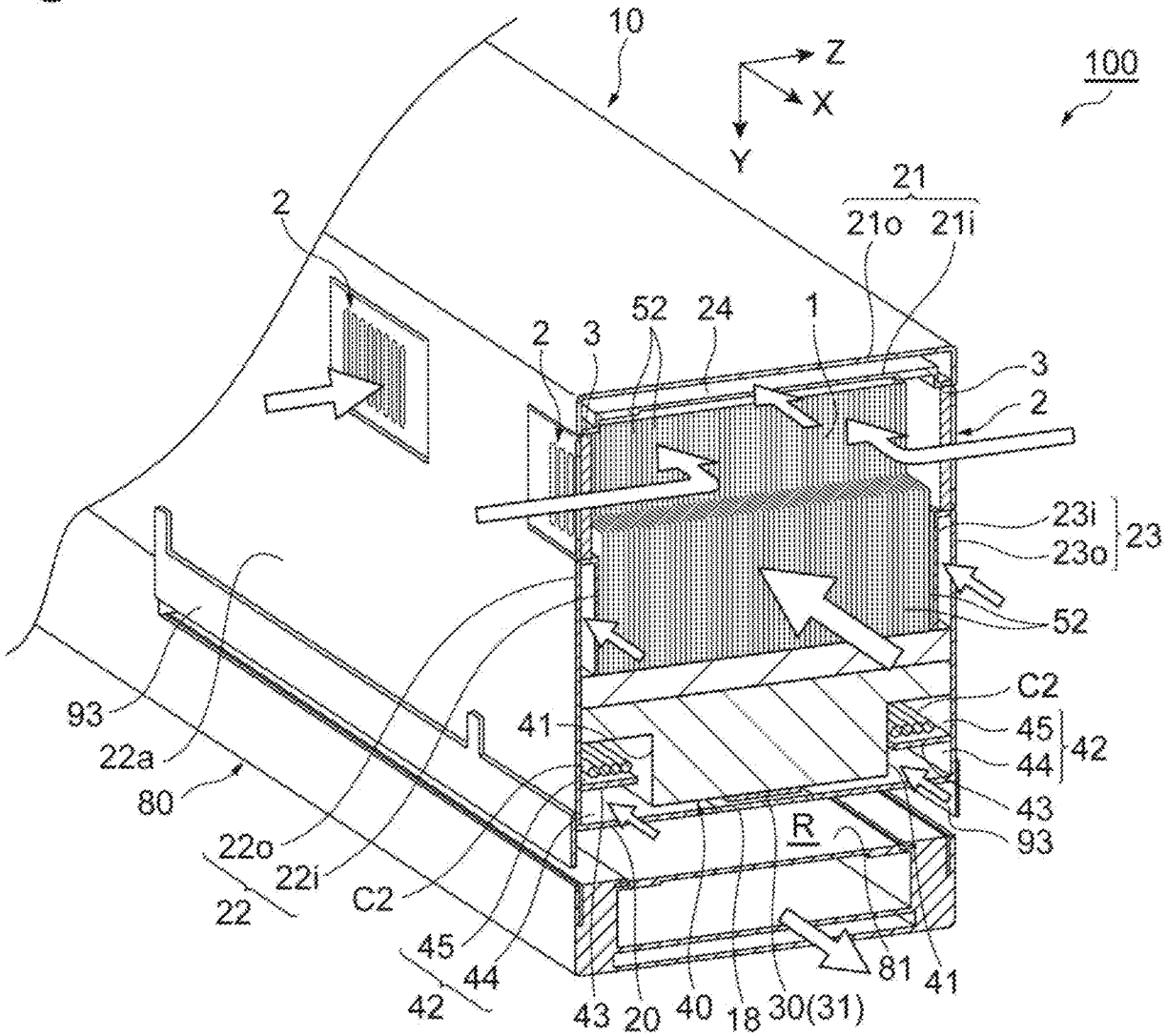
FIG. 5 is a cross section view for showing an air flow in the light source device in FIG. 1.
Figure 6:
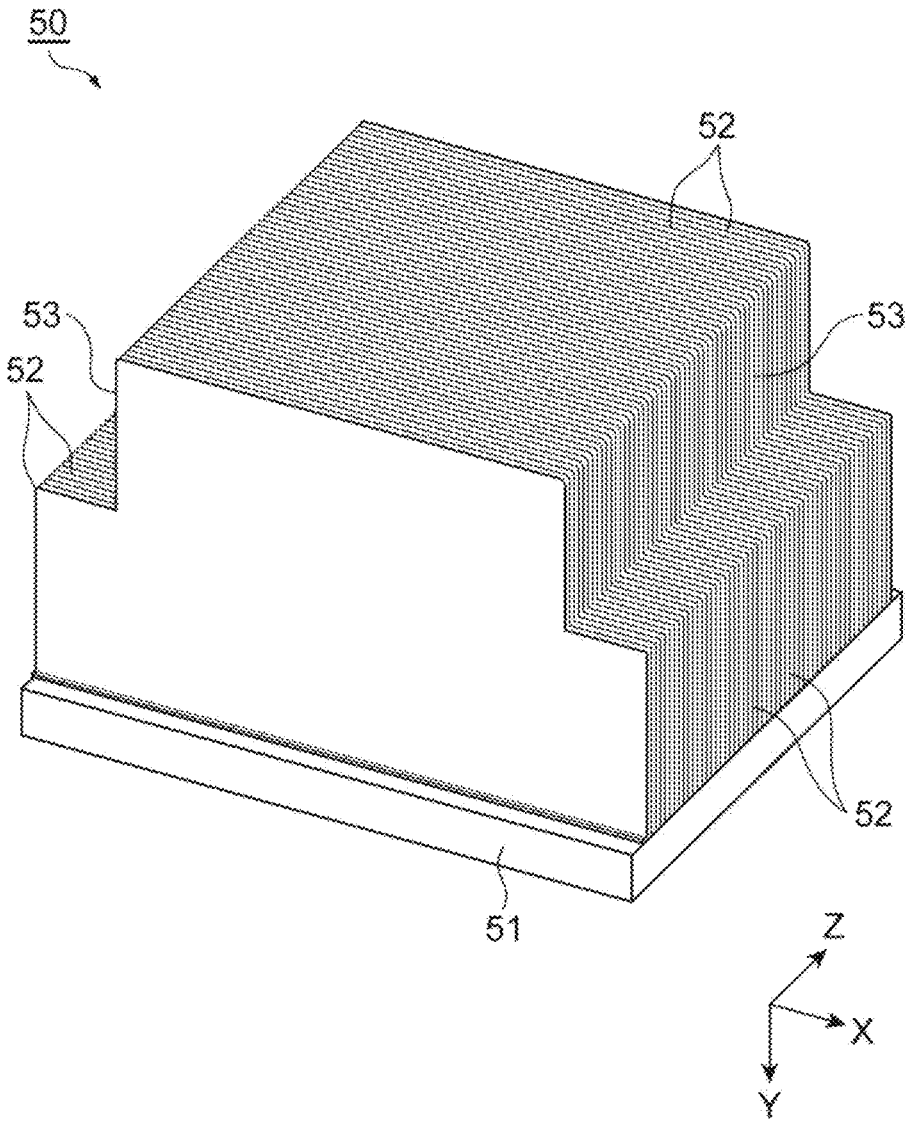
FIG. 6 is a perspective view showing a heat sink of the light source device in FIG. 1.

As shown in FIGS. 1 and 2, a light source device 100 is a high-power air-cooled LED light source for use in printing, for example. The light source device 100 can be used as a light source unit which has a great length and is mounted onto a UV printing apparatus (UV printer), for example. The light source device 100 emits light such as ultraviolet light, and dries ink, for example. The light source device 100 includes a housing 10, a plurality of LED substrates 30, a supporting block 40, a plurality of heat sinks 50, a pair of driving circuits 60, a radial-flow fan 70, and a light shielding case 80.

It is noted that for convenience in description, description will be made assuming that a lengthwise direction (predetermined direction) of the housing 10 is an "X direction", a direction in which light is emitted from LED elements 31 of the LED substrates 30, being perpendicular to an X direction, is a "Y direction", and a widthwise direction of the light source device 100, being orthogonal to an X direction and a Y direction is a "Z direction". Also, description will be made assuming that a side toward which the LED elements 31 emit light is a "lower side" and a side opposite thereto is an "upper side".

The housing 10 is in a form of a rectangular box having a great length along an X direction. The housing 10 is formed of metal. The housing 10 holds the LED substrates 30, the supporting block 40, the heat sinks 50, and the driving circuits 60.

In one end surface (one end) 10*a* on one side of the housing 10 in an X direction, a first intake port 11 through which air is sucked into the housing 10 from the outside is provided. The first intake port 11 is formed so as to open outward in an X direction. A filter 11*a* formed of urethane or the like, for example, is attached to the first intake port 11. A grip unit 12 for gripping the housing 10 is provided in the one end surface 10*a*.

In the other end surface (the other end) 10*b* on the other side of the housing 10 in an X direction, an exhaust port 13 through which air is discharged to the outside from the housing 10 is provided. The exhaust port 13 is connected with a blower 91 which sucks air, via a pipe 92 having bellows. Accordingly, in the housing 10, a pressure of air on one side in an X direction is higher than that on the other side, and air flows from one side to the other side in an X direction. In the following description, one side in an X direction will be also referred to as an "upstream side", and the other side in an X direction will be also referred to as a "downstream side".

As shown in FIGS. 2 to 6, the housing 10 includes a body section 15 and a downstream section 25 located downstream of the body section 15. An outline of the body section 15 takes a shape of a rectangular parallelepiped having a great length along an X direction. An end surface on an upstream side of the body section 15 corresponds to the above-described one end surface 10*a*. In the body section 15, the LED substrates 30, the supporting block 40, and the heat sinks 50 are placed. In an upstream portion of a lower surface (lower side surface) of the body section 15, a communication port 16 which communicates with a later-described light-shielding-case exhaust port 82 of the light shielding case 80, is formed. A lid unit 17 in which a plurality of slits are formed is attached to the communication port 16. In a downstream portion of the body section 15, a buffer unit 19 serving as a buffer space for buffering an air flow is provided.

The body section 15 includes a lower sidewall unit 20, an upper sidewall unit 21, and a pair of sidewall units 22 and 23 which are continuous with those sidewall units 20 and 21 and are opposite to each other along a Z direction. In the lower sidewall unit 20, a light emission window 18 which allows light provided from the LED substrates 30 to pass therethrough is provided. Each of the upper sidewall unit 21 and the pair of sidewall units 22 and 23 which are opposite to each other along a Z direction is configured to have a double-wall structure. The sidewall unit 21 includes an outer sidewall 210 and an inner sidewall 21*i*. The sidewall unit 22 includes an outer sidewall 22*o* and an inner sidewall 22*i*. The sidewall unit 23 includes an outer sidewall 23*o* and an inner sidewall 23*i*.

Each of the outer sidewalls 21*o*, 22*o*, and 23*o* is a flat-plate-shaped wall member which forms a periphery of the body section 15 (between the first intake port 11 and the exhaust port 13). The outer sidewall 210 is provided orthogonally to, and continuously with, the outer sidewalls 22*o* and 23*o*. The inner sidewalls 21*i*, 22*i*, and 23*i* are flat-plate-shaped wall members which are placed inwardly with respect to the outer sidewalls 21*o*, 22*o*, and 23*o*, respectively. The inner sidewall 21*i* is provided orthogonally to, and continuously with, the inner sidewalls 22*i* and 23*i*. The inner sidewalls 21*i*, 22*i*, and 23*i* extend along an X direction from a position located downstream of the first intake port 11 by a predetermined distance, to the buffer unit 19. Lower ends of the inner sidewalls 22*i* and 23*i* are positioned in the neighborhood of centers of a Y direction in the outer sidewalls 22*o* and 23*o*.

An inter-wall space 24 in which air sucked through the first intake port 11 and the communication port 16 is allowed to flow along an X direction is formed between the outer sidewalls 21*o*, 22*o*, and 23*o* and the inner sidewalls 21*i*, 22*i*, and 23*i*, respectively. The inter-wall space 24 has an inverted-U-shaped longitudinal section in a state shown in FIG. 5. Clearances between the outer sidewalls 22*o* and 23*o* and the inner sidewalls 22*i* and 23*i* are enclosed by lower ends of the inner sidewalls 22*i* and 23*i*. In such the inter-wall space 24, portions on an upstream side and a downstream side communicate with the housing 10, and a lower end is blocked.

An outline of the downstream section 25 takes a shape of a rectangular parallelepiped of which upper portion protrudes over the body section 15. The downstream section 25 is provided continuously with the body section 15. An end surface of the downstream section 25 on a downstream side corresponds to the above-described other end surface 10*b*. The downstream section 25 is partitioned into a wire holding space 27 and a ventilation space 28 by a partition plate 26 in a shape of a flat plate extending along an X-Z plane. The wire holding space 27 is a space above the partition plate 26 in the downstream section 25, and is defined (demarcated) in an upper portion within the downstream section 25. In the wire holding space 27, a wire C1 is collectively held. The ventilation space 28 is a space in which air flows, and communicates with the body section 15 and the exhaust port 13. The ventilation space 28 is a space below the partition plate 26 in the downstream section 25. In the ventilation space 28, the pair of driving circuits 60 are placed.

The LED substrates 30 include substrates each of which forms a predetermined circuit and has a shape of a rectangular plate, and the LED elements 31 serving as light emitting elements which are arranged side by side with predetermined pitches along an X direction and a Y direction on those substrates. The LED elements 31 emit light such as ultraviolet light downward. The LED substrates 30 are arranged side by side along an X direction on a lower surface of the supporting block 40. Accordingly, several to several hundreds of LED elements 31 are arranged along at least an X direction in the housing 10. Light emitted from each of the LED elements 31 of the plurality of LED substrates 30 is irradiated, via the light emission window 18 of the housing 10, to an illuminated object which passes through a later-described passage area R. As an illuminated object, a printed material on which light-(UV-light-) curing ink deposits is cited, for example.

The supporting block 40 is formed of metal and is placed on a lower side in the body section 15 of the housing 10. The plurality of LED substrates 30 are arranged side by side along an X direction on a lower surface of the supporting block 40. On an upper surface of the supporting block 40, the plurality of heat sinks 50 are arranged side by side along an X direction. Notches 41 each of which is a portion cut out in a rectangular shape in a longitudinal section are formed to extend along an X direction, on lower sides of opposite ends of a Z direction in the supporting block 40 (refer to FIG. 5). The notches 41, in collaboration with the sidewall unit 20 of the housing 10, form lower spaces 42. In other words, the lower spaces 42 are defined by the notches 41 and the sidewall unit 20.

The lower space 42 extends from an upstream portion of the body section 15 to a position ahead of the buffer unit 19 (a position located upstream of the buffer unit 19) along an X direction. The lower space 42 is partitioned into an upper portion and a lower portion by a partition plate 43. Accordingly, in the lower space 42, a first lower space 44 and a second lower space 45 above the first lower space 44 are formed. The first lower space 44 mainly serves as a space in which air sucked through the first intake port 11 and the communication port 16 is allowed to flow along an X direction. The first lower space 44 allows air to flow along an inner surface of the sidewall unit 20 of the housing 10, to thereby suppress temperature rise of the sidewall unit 20. The second lower space 45 mainly serves as a space in which a wire C2 is collectively held.

The heat sinks 50 are heat dissipation members which are thermally connected with the LED elements 31 of the LED substrates 30. The plurality of (three in this embodiment) heat sinks 50 are placed on an upper surface of the supporting block 40, so as to be arranged at predetermined intervals along an X direction. The heat sink 50 includes a base 51 and a plurality of heat dissipation fins 52.

The base 51 takes a shape of a rectangular plate. The base 51 is connected with an upper surface of the supporting block 40. Accordingly, the base 51 is thermally coupled to the LED elements 31 of the LED substrates 30 via the supporting block 40. The heat dissipation fin 52 takes a shape of a flat plate having a width along a Z direction and a great length along an X direction. The heat dissipation fins 52 are arranged so as to be stacked at some intervals along a Z direction. The heat dissipation fins 52 are erected on the base 51.

In the heat dissipation fins 52, notches 53 are formed. The notches 53 are portions resulted from cutting-out of respective portions of the plurality of heat dissipation fins 52. More specifically, the notches 53 are portions resulted from cutting-out of respective upper corners of the plurality of rectangular heat dissipation fins 52 in rectangular shapes when seen from a Z direction. That is, when seen from a Z direction, the heat dissipation fin 52 has a shape which protrudes upward in a form of a rectangular pulse, and the notch 53 is formed by a level difference provided in each of opposite ends of an X direction in the heat dissipation fin 52. The notch 53 in this embodiment extends to the neighborhood of a center of a Y direction in the heat dissipation fin 52 (refer to FIG. 6).

The heat dissipation fins 52 are erected in an area not including opposite ends of a Z direction on the base 51. In other words, an area where the heat dissipation fins 52 are not provided is formed in each of opposite ends of a Z direction on the base 51. In the opposite ends of a Z direction on the base 51, the sidewall units 22 and 23 each having a double-wall structure are placed respectively.

The driving circuits 60 are electric driving-circuit boards for driving the light source device 100. The driving circuits 60 are placed so as to be paired with each other in the ventilation space 28 of the downstream section 25. Accordingly, the driving circuits 60 are placed downstream of the LED substrates 30 by a predetermined distance or larger along an X direction. In this embodiment, the driving circuits 60 are located downstream of the LED substrates 30 by some distance with the buffer unit 19 being interposed therebetween.

The pair of driving circuits 60 are placed in such a manner that respective component mounting surfaces 60*a* face each other along a direction crossing an X direction (a Y direction in this embodiment). More specifically, one of the driving circuits 60 is placed on a lower side in the ventilation space 28 in such a manner that the component mounting surface 60*a* faces upward. The other of the driving circuits 60 is placed on an upper side in the ventilation space 28 in such a manner that the component mounting surface 60*a* faces downward.

The driving circuit 60 includes a circuit heat sink 61 which dissipates heat of the driving circuit 60. The circuit heat sink 61 is provided in the component mounting surface 60*a*. The pair of driving circuits 60 are placed in such a manner that the respective circuit heat sinks 61 do not overlap each other along an X direction. In an example shown in the drawings, the pair of driving circuits 60 have a positional relationship in which the driving circuits 60 are symmetrical with respect to a point between the driving circuits 60 when seen from a Z direction.

The radial-flow fan 70 is fixed to a lower surface of the downstream section 25 of the housing 10. The radial-flow fan 70 sucks air from a lower side along a Y direction and feeds the air under pressure to one side of an X direction (an upstream side of air in the housing 10).

The light shielding case 80 is in a form of a rectangular box which has a great length along an X direction and is flattened along a Y direction. The light shielding case 80 is formed of metal. The light shielding case 80 is removably attached on a lower side in the body section 15 of the housing 10, and protects the light emission window 18 of the body section 15 from light. The light shielding case 80 is inserted into an air-outlet side of the radial-flow fan 70, and the inside of the light shielding case 80 communicates with an air-outlet side of the radial-flow fan 70. In an upper surface of the light shielding case 80, a groove 81 which defines the passage area R is formed. The passage area R is an area where an illuminated object passes along a Z direction. A bottom surface of the groove 81 faces the light emission window 18. In an upper surface on one side in an X direction in the light shielding case 80, the light-shielding-case exhaust port 82 through which air is discharged from the light shielding case 80 is formed. The light-shielding-case exhaust port 82 communicates with the communication port 16 of the housing 10 while the light shielding case 80 is attached to the housing 10.

Within the light shielding case 80 configured in the above described manner, air which is sucked and fed under pressure by the radial-flow fan 70 flows from the other side to one side in an X direction (in a direction reverse to a direction of an air flow in the housing 10) in the light shielding case 80. Accordingly, a bottom surface of the groove 81 of which temperature is increased by light which is provided through the light emission window 18 and falls on the bottom surface, is cooled. The air flows into an upstream portion of the housing 10 through the light-shielding-case exhaust port 82 via the communication port 16, and merges with air sucked through the first intake port 11. As a result of this, the air sucked through the first intake port 11 flows from one side to the other side in an X direction, together with the air provided from the light shielding case 80.

It is noted here that a space 1 of which downstream side (the other side in an X direction) faces the heat sinks 50 is formed in the housing 10. In other words, upstream sides of the heat dissipation fins 52 of the heat sinks 50 face the space 1. The heat dissipation fins 52 are placed downstream of the space 1.

The space 1 is a place where the heat dissipation fins 52 are not provided in the housing 10. The space 1 has a certain volume or higher. The space 1 is a vacant place in the housing 10. The space 1 is formed between a pair of adjacent heat sinks 50. The space 1 is defined by the notches 53 formed in the respective heat dissipation fins 52 of a pair of adjacent heat sinks 50. More specifically, the space 1 is defined by the respective notches 53 of a pair of adjacent heat sinks 50 and the inner sidewalls 21*i*, 22*i*, and 23*i*, and takes a shape of a rectangular parallelepiped.

A plurality of (two in this embodiment) second intake ports 2 through which air is sucked from the outside into the space 1 are provided in each of the respective side surfaces 22*a* and 23*a* of the pair of sidewall units 22 and 23 in the body section 15. That is, the plurality of second intake ports 2 which connect the space 1 directly to the outside are formed in each of the side surfaces 22*a* and 23*a* between the first intake port 11 and the exhaust port 13 in the housing 10.

The second intake port 2 opens in a Z direction. The second intake port 2 includes an outer lid in which a plurality of slits are formed. A filter 3 formed of urethane or the like, for example, is attached to the second intake port 2. The second intake port 2 is provided in a position where the second intake port 2 overlaps the space 1 when seen from a Z direction. The space 1 is positioned in the neighborhood of (around) the second intake ports 2. The second intake port 2 which is formed in the side surface 22*a* and the second intake port 2 which is formed in the side surface 23*a* face each other along a Z direction. The second intake ports 2 are provided in an upper end (that is, an end spaced apart from an illuminated object) of each of the side surfaces 22*a* and 23*a*.

The second intake ports 2 are provided so as not to communicate with the inter-wall space 24 while communicating with the space 1. For example, the second intake port 2 includes a through hole which penetrates the outer sidewall 22*o* and the inner sidewall 22*i*, and the through hole is closed to the outer sidewall 22*o* and the inner sidewall 22*i*. The second intake port 2 penetrates the inter-wall space 24 until it reaches the space 1 while keeping itself from communicating with the inter-wall space 24.

In this connection, a cover 93 with which the passage area R is covered is attached to a lower end of each of the side surfaces 22*a* and 23*a* of the housing 10. The cover 93 is a plate member having a width along a Z direction and a great length along an X direction. The cover 93 protects the passage area R from light.

As described above, in the light source device 100, while air sucked through the first intake port 11 on one side in an X direction is flowing along an X direction toward the exhaust port 13 on the other side in the housing 10, fresh air provided from the outside is sucked into the space 1 in the housing 10 via the second intake ports 2 in the side surfaces 22*a* and 23*a*. Since a downstream side of the space 1 faces the heat dissipation fins 52 of the heat sinks 50, the fresh air sucked into the space 1 easily flows into the heat sinks 50 (among the heat dissipation fins 52) on a downstream side.

Accordingly, temperature rise of the LED elements 31 which are provided on a side close to the exhaust port 13 and are easily subjected to temperature rise can be effectively suppressed. A temperature gradient among the plurality of LED elements 31 can be reduced, and a difference in temperature between the LED element 31 in the neighborhood of the first intake port 11 and the LED element 31 in the neighborhood of the exhaust port 13 can be reduced, so that temperatures of the plurality of LED elements 31 can be equalized. An efficiency of cooling the light source device 100 as a whole can be increased, which makes it possible to miniaturize the device. An illuminance gradient among the plurality of LED elements 31 is reduced, so that a difference in illuminance between the LED element 31 in the neighborhood of the first intake port 11 and the LED element 31 in the neighborhood of the exhaust port 13 can be reduced.

In the light source device 100, the space 1 is defined by the notches 53 formed in the heat dissipation fins 52. Because of such a configuration of the space 1, it is possible to effectively achieve a technique in which fresh air is sucked from the outside via the second intake ports 2 and is allowed to flow among the heat dissipation fins 52.

In the light source device 100, the space 1 is formed between a pair of adjacent heat sinks 50. In this situation, in a case where the plurality of heat sinks 50 are placed, the space 1 can be efficiently formed.

In the light source device 100, the space 1 is defined by the notches 53 formed in the respective heat dissipation fins 52 of a pair of adjacent heat sinks 50. Because of such a configuration of the space 1, in a case where the plurality of heat sinks 50 are placed, it is possible to effectively achieve a technique in which fresh air is sucked from the outside via the second intake ports 2 and is allowed to flow among the heat dissipation fins 52.

In the light source device 100, the second intake ports 2 are provided in respective ends on an upper side spaced apart from an illuminated object in the side surfaces 22*a* and 23*a*. In this situation, mist or the like which is possibly produced from an illuminated object can be prevented from being sucked into the housing 10 via the second intake ports 2.

In the light source device 100, each of the sidewall units 21, 22, and 23 of the housing 10 has a double-wall structure, and the inter-wall space 24 in which air sucked through the first intake port 11 is allowed to flow along an X direction is formed. The second intake ports 2 are provided so as not to communicate with the inter-wall space 24 while communicating with the space 1. Accordingly, air sucked through the first intake port 11 is allowed to flow in the inter-wall space 24, and so it is possible to surely allowing outside fresh air sucked through the second intake ports 2 to flow into not the inter-wall space 24, but the space 1, and then, among the heat dissipation fins 52, while suppressing temperature rise of the sidewall units 21, 22, and 23 of the housing 10.

Figure 7:
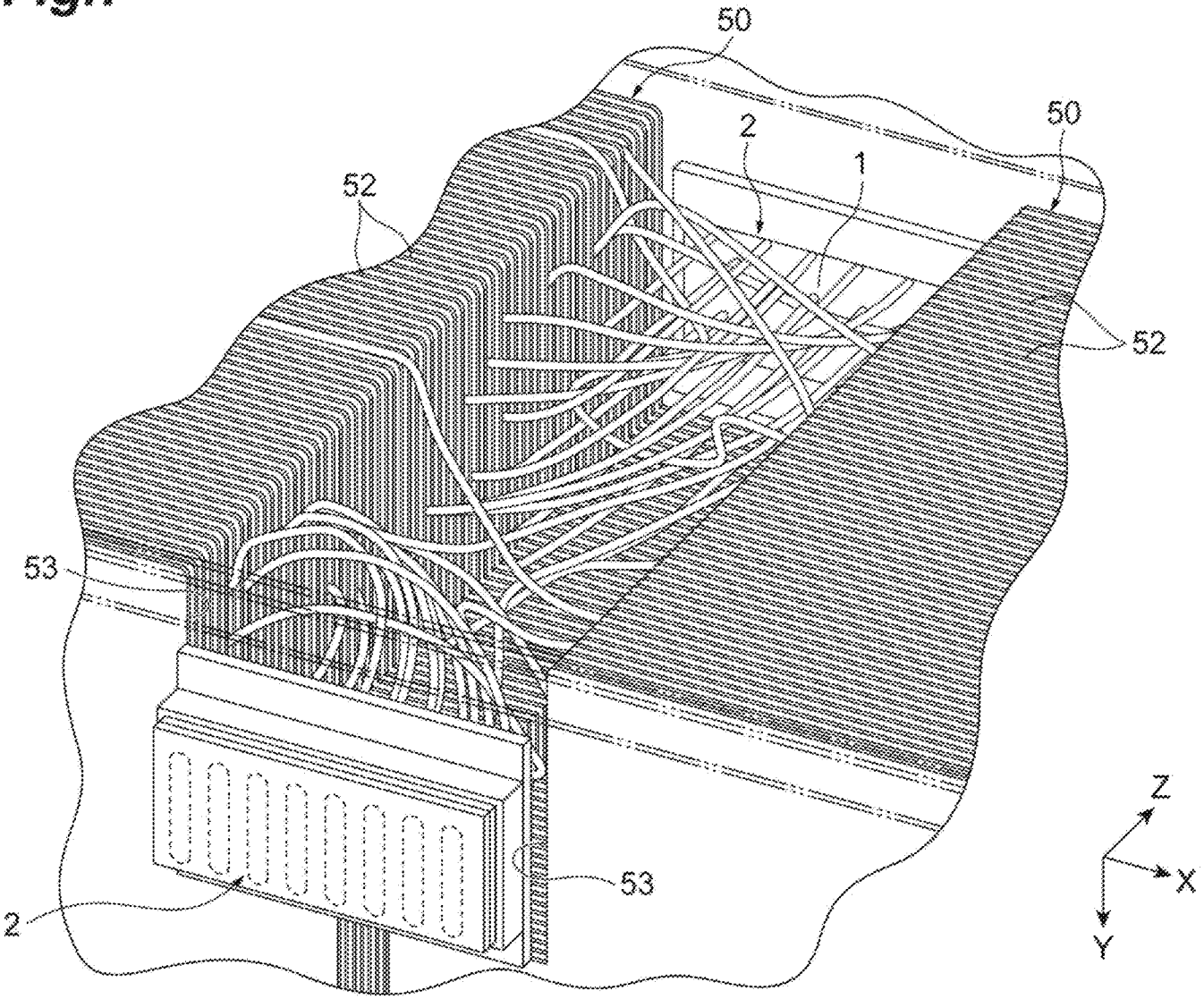
FIG. 7 is a perspective view for showing a simulation result of an air flow around a second intake port.

FIG. 7 is a perspective view for showing a simulation result of an air flow around the second intake ports 2. In FIG. 7, an air flow is shown by stream lines. The simulation result in FIG. 7 indicates that fresh air which is sucked into the space 1 in the housing 10 via the second intake ports 2 can be surely allowed to flow among the heat dissipation fins 52 on a downstream side.

Figure 8:
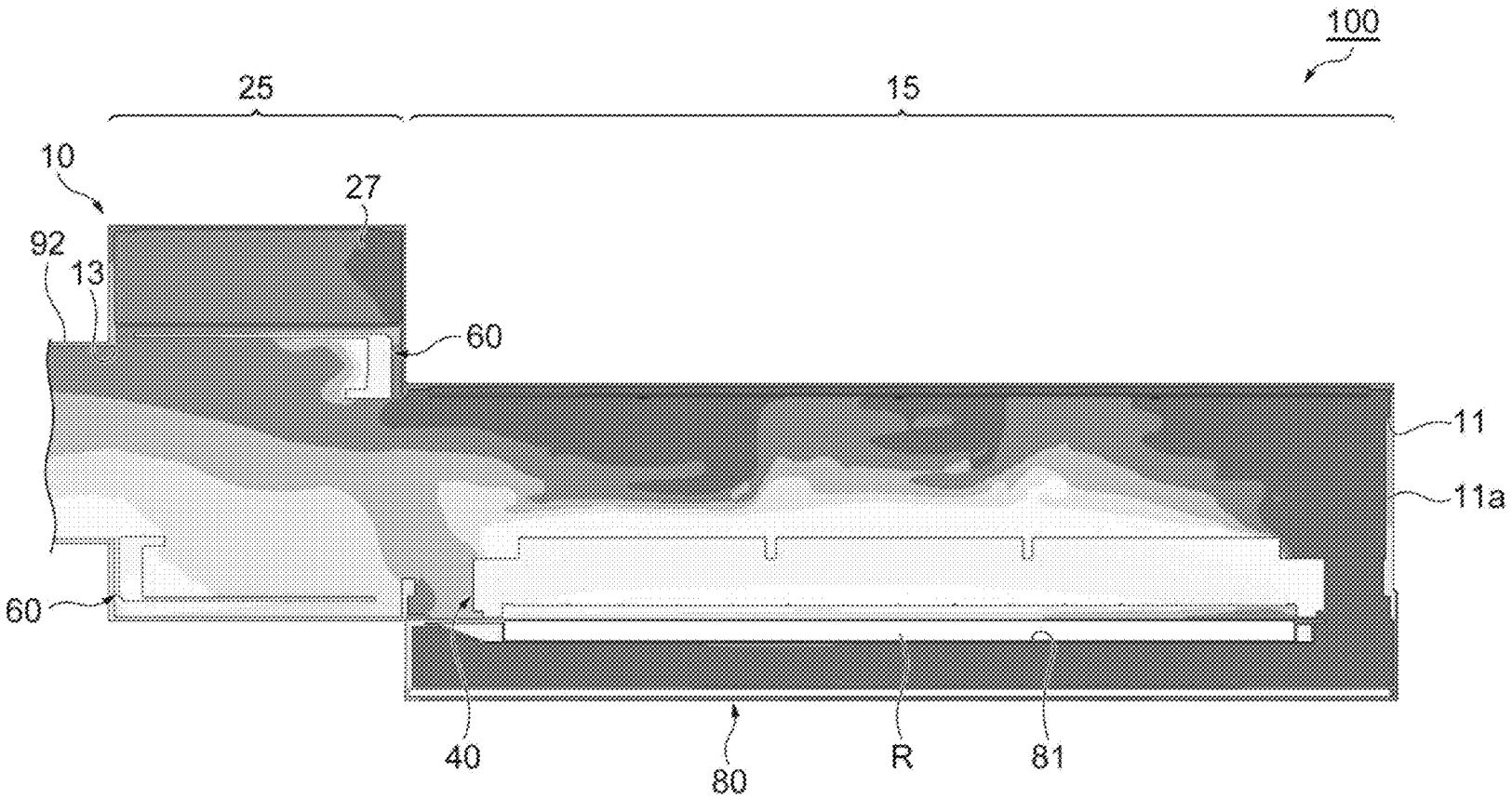
FIG. 8 is a section view for showing a simulation result of temperature distribution in a housing.

FIG. 8 is a section view for showing a simulation result of temperature distribution in the housing 10. In FIG. 8, a level of a temperature is shown by a color gradation, and a darker color means a lower temperature. A section in FIG. 8 corresponds to a section in FIG. 4 except that the buffer unit 19 and the radial-flow fan 70 are omitted. The simulation result in FIG. 8 indicates that temperature rise of the LED element 31 which is provided on a side close to the exhaust port 13 and is easily subjected to temperature rise is suppressed and a temperature gradient among the plurality of LED elements 31 is reduced, so that temperatures of the plurality of LED elements 31 can be equalized.

In the light source device 100, a temperature of the light shielding case 80 may possibly be increased to approximately 200° C., for example, when light emitted via the light emission window 18 falls on the light shielding case 80. In this situation, a temperature of the sidewall unit 20 on a lower side in the housing 10 may possibly be increased under the influence of heat of the light shielding case 80. In this regard, in the light source device 100, the lower space 42 (the first lower space 44) in which air is allowed to flow along an inner surface of the sidewall unit 20 of the housing 10 is provided. This can suppress temperature rise of the sidewall unit 20.

In the light source device 100, the filter 3 is attached to the second intake port 2. Accordingly, dust can be prevented from entering into the housing 10 via the second intake port 2.

In the light source device 100, the driving circuits 60 are placed downstream of the LED substrates 30 by a predetermined distance or larger along an X direction. More specifically, the driving circuits 60 are located downstream of the LED substrates 30 by some distance with the buffer unit 19 being interposed therebetween, and are provided in an end on a downstream side in the housing 10 in this embodiment. Accordingly, it is possible to prevent heat of the driving circuits 60 from adversely affecting cooling of the LED elements 31. The driving circuits 60 are cooled by air used for cooling the LED elements 31, and thus, an efficiency of cooling of the light source device 100 as a whole can be increased. The driving circuits 60 can be cooled by air of which flow is buffered by the buffer unit 19.

The light source device 100 includes the pair of driving circuits 60. The pair of driving circuits 60 are placed in such a manner that the respective circuit heat sinks 61 do not overlap each other along an X direction. This configuration allows heat of the respective circuit heat sinks 61 to be effectively dissipated by air flowing along an X direction.

In the light source device 100, the downstream section 25 of the housing 10 is partitioned into the wire holding space 27 and the ventilation space 28 by the partition plate 26. Accordingly, a space in which the wire C1 is held and a space in which air flows are separated from each other, so that it is possible to prevent an air flow from becoming turbulent due to presence of the wire C1.

The light source device 100 includes the light shielding case 80. With the light shielding case 80, it is possible to shut out light emitted via the light emission window 18 while forming the passage area R where an illuminated object passes or is placed.

In the light source device 100, in a space inside the light shielding case 80, air flows in a reverse direction (from the other side to one side in an X direction) with respect to an air flow in the housing 10. With this configuration, by causing air to flow within the light shielding case 80, it is possible to effectively cool a downstream side of the housing 10 which is easily subjected to temperature rise while suppressing temperature rise of the light shielding case 80 due to light falling thereon via the light emission window 18.

One aspect of the present invention is not limited to the above-described embodiment, and can be altered within a scope not changing the gist recited in claims, or can be applied to the other designs.

Figure 9A:
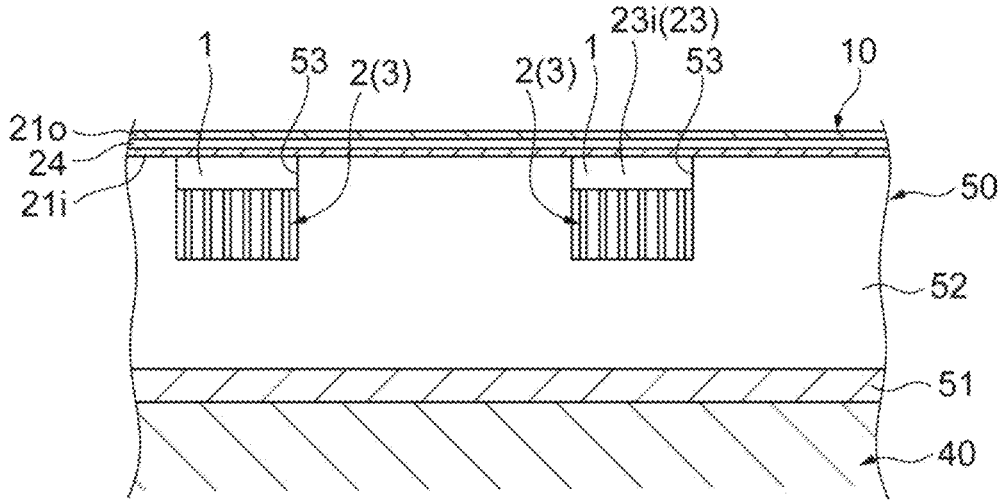
FIG. 9A is an enlarged section view showing a light source device according to a first modification.

Though the plurality of heat sinks 50 are provided in the above-described embodiment, a single heat sink 50 having a great length along an X direction may be provided as show in FIG. 9A, for example. The space 1 may be defined by the notches 53 which are grooves or recesses formed in the heat dissipation fins 52 of the single heat sink 50.

Figure 9B:
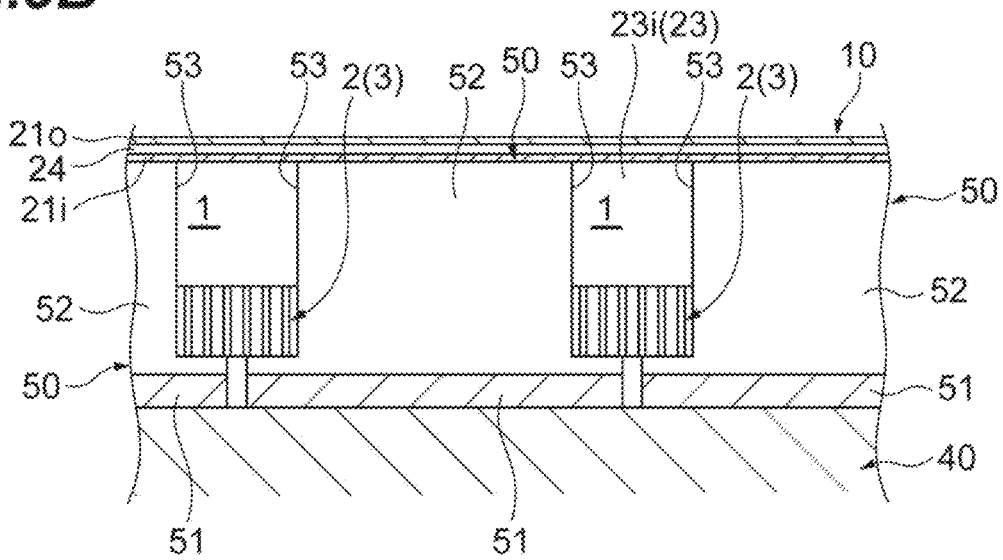
FIG. 9B is an enlarged section view showing a light source device according to a second modification.

Though the second intake ports 2 are provided in upper ends of the side surfaces 22*a* and 23*a* in the above-described embodiment, the positions of the second intake ports 2 in the side surfaces 22*a* and 23*a* are not limited to any specific positions. For example, as shown in FIG. 9B, the notches 53 each of which extends to a position near to the base 51 along a Y direction may be formed in the heat dissipation fins 52, and the second intake ports 2 may be provided in longitudinal centers in the side surface 23*a*.

Figure 10:
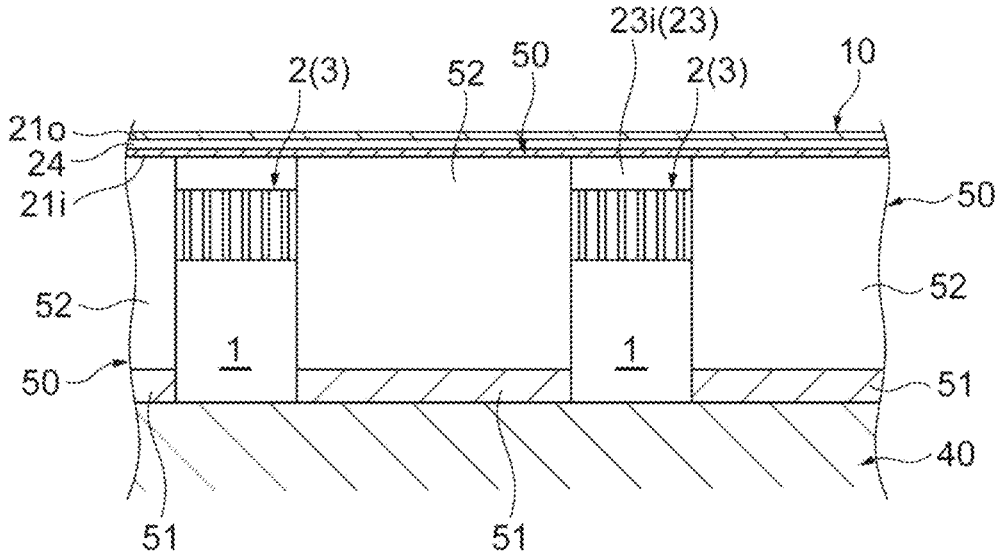
FIG. 10 is an enlarged section view showing a light source device according to a third modification.

Though the space 1 is defined by the notches 53 provided in the heat dissipation fins 52 of the heat sinks 50 in the above-described embodiment, the notches 53 can be omitted on condition that a downstream side of the space 1 faces the heat dissipation fins 52. For example, as shown in FIG. 10, each of the heat dissipation fins 52 may be formed in a shape of a rectangular plate in which the notch 53 (refer to FIG. 4) is not provided, and the space 1 may be formed between the plurality of heat sinks 50.

Though the second intake ports 2 are provided in the side surfaces 22*a* and 23*a* in the above-described embodiment, configurations of the second intake ports 2 are not limited to that. The second intake ports 2 may be provided in at least one of the side surfaces 22*a* and 23*a*, and as alternative to that, or in addition to that, the second intake ports 2 may be provided in an upper side surface (a side surface of the sidewall unit 21). Regarding the number of the second intake ports 2, either one second intake port 2 or a plurality of second intake ports 2 may be provided in each side surface. The number of the second intake ports 2 may be determined in accordance with a temperature gradient among the plurality of LED elements 31.

Each of the heat sinks 50 may include a heat pipe in the above-described embodiment. In the above-described embodiment, a third intake port through which air is sucked into the buffer unit 19 from the outside may be further included in a position where the third intake port faces the buffer unit 19 in a side surface between the first intake port 11 and the exhaust port 13 of the housing 10.

Though the plurality of LED substrates 30 in which the plurality of LED elements 31 are provided are arranged side by side along an X direction in the above-described embodiment, the manner in which the LED substrates 30 and the LED elements 31 are arranged is not limited to any specific manner, and it will be sufficient if the plurality of LED elements 31 are arranged along at least an X direction. Also, a light emitting element is not limited to the LED element 31, and the other known light emitting element may be used.

According to one aspect of the present invention, a light source device which can equalize temperatures of a plurality of light emitting elements can be provided.

What is claimed is:

1. A light shielding case attached to a light source device, wherein the light source device includes:

a housing configured to have a length along a predetermined direction, a plurality of light emitting elements configured to be placed in the housing and arranged along at least the predetermined direction, one or a plurality of heat dissipation members configured to be placed in the housing and thermally connected with the light emitting elements, a first intake port through which air is sucked into the housing from an outside provided in one end on one side of the housing in the predetermined direction, and an exhaust port through which air is discharged to the outside from the housing provided in another end on an other side of the housing in the predetermined direction, the light shielding case attached to the housing, and the light shielding case is configured to shield light of the light source device so as to prevent the light from escaping to the outside.

2. The light shielding case according to claim 1, wherein the housing is provided with a light emission window configured to allow light from the light emitting elements to pass through, the shielding case is attached to the housing and configured to shield the light emission window from light, and a surface on the light emission window side of the shielding case is formed with a passage area through which an illuminated object illuminated by light of the light emitting elements passes.

3. The light shielding case according to claim 1, wherein the light shielding case is removably attached to the housing.

4. The light shielding case according to claim 2, wherein an inside of the light shielding case is configured to communicate with an air-outlet side of a fan, and on the inside of the light shielding case air which is sucked and fed under pressure by the fan flows in the predetermined direction and the light emission window side of the shielding case is cooled by the air.

5. The light shielding case according to claim 4, wherein the air flowing in the predetermined direction on the inside of the light shielding case flows from an light-shielding-case exhaust port to the housing and mixes with the air sucked through the first intake port on an inside of the housing.

6. The light shielding case according to claim 1, wherein a space in which the other side in the predetermined direction faces the at least one heat dissipation member is formed in the housing, and a second intake port through which air is sucked into the space from the outside of the housing is provided in a side surface between the first intake port and the exhaust port in the housing.

7. The light shielding case according to claim 6, wherein the second intake port is provided at a position other than a side toward which the plurality of light emitting elements emit light in the housing, and the second intake port faces the space at a portion in which the at least one heat dissipation member is not formed in an area in the housing, the at least one heat dissipation member faces the space.

8. The light shielding case according to claim 7, wherein the housing includes an outer sidewall between the first intake port and the exhaust port, and an inner sidewall located inwardly with respect to the outer sidewall, an inter-wall space in which air sucked through the first intake port is allowed to flow along the predetermined direction is formed between the outer sidewall and the inner sidewall in the housing, and the second intake port is provided so as not to communicate with the inter-wall space while communicating with the space.

* * * * *